United States Patent [19]

Seiler

[11] Patent Number: 4,969,490

[45] Date of Patent: Nov. 13, 1990

[54] LIFT BLADE AND HOOKING ENGAGEMENT SHED-FORMING APPARATUS WITH ELECTROMAGNET

[75] Inventor: Wolfgang Seiler, Mönchengladbach, Fed. Rep. of Germany

[73] Assignee: Oskar Schleicher, Mönchengladbach, Fed. Rep. of Germany

[21] Appl. No.: 348,265

[22] Filed: May 5, 1989

[30] Foreign Application Priority Data

May 21, 1988 [DE] Fed. Rep. of Germany ..... 3817417

[51] Int. Cl.[5] ..... D03C 3/20; D03C 3/06

[52] U.S. Cl. ..... 139/455; 139/59; 139/65

[58] Field of Search ..... 139/59, 65, 455

[56] References Cited

U.S. PATENT DOCUMENTS 4,530,382 7/1985 Schleicher ..... 139/65
4,702,286 10/1987 Palau et al. ..... 139/65

FOREIGN PATENT DOCUMENTS 0214073 3/1987 European Pat. Off. ..... 139/65
2073788 10/1981 United Kingdom ..... 139/59

*Primary Examiner*—Andrew M. Falik
*Attorney, Agent, or Firm*—Sommer, Oliverio & Sommer

[57] ABSTRACT

A shed-forming device for a textile machine which includes lift blades (e.g., 3) arranged to hookingly engage or slidably contact an associated hooking engagement element (e.g., 4) such that the hooking engagement element is either lifted into an upper shed position to effect a shed change or alternatively, is pivoted into an arrested lower shed position by the attractive force of an associated electromagnet (e.g., 5). The hooking engagement elements are arranged in pairs by flexible connecting elements (e.g., 9) which form a loop into which is disposed a roller (e.g., 12) operatively attached to a shed such as a harness (e.g., 13). A pulling force generated by the movement of the roller and harness serves to pivot or position the hooking engagement element for cooperation with the lift blades and accordingly, facilitates changing of the harness.

6 Claims, 1 Drawing Sheet

LIFT BLADE AND HOOKING ENGAGEMENT SHED-FORMING APPARATUS WITH ELECTROMAGNET

BACKGROUND OF THE INVENTION

The invention provides a lift blade and engagement shed-forming apparatus for a textile machine and, in particular, a loom.

One form of shed-forming device for a textile machine, comprises lift blades which are movable in opposite relationship to each other, and hooking engagement elements which can be engaged by the lift blades in a hooking engagement position, and which are connected in pairs by flexible connecting members forming loop configurations. The device further includes rollers carried in the loops, operatively connected to the shedding means, such as the heald train or harness train of the textile machine. Stationary electromagnetic means act on the hooking engagement elements holding the elements in position and are adapted to be actuated by way of program carriers.

In the preferred embodiment of the invention each of the pair of hooking engagement elements is capable of being positioned in either of two discrete vertical locations. Specifically, when one of the hooking engagement elements is in the engaged position, i.e., engaged by the lift blades and moved upwardly into the upper-shed position, the other of the pair of hooking engagement elements is held in a lower-shed position. In the preferred embodiment, one element is retained in the upper-shed position if a change in shed is to be effected by the harness connected to the roller.

Another device of the general kind outlined above is disclosed, in European patent specifications Nos. 0 188 074 and 0 119 787. In those devices the hooking engagement element must be attracted by the magnets across a respective air gap in order to be held in a desired position. Thus, the part of the hooking engagement element to be attracted by the magnet means is of a long and blade-like configuration. This air gap requires that the electromagnet device produce a strong attractive force, which, inter alia, gives rise to a relatively high level of power consumption. Furthermore, this arrangement produces a large amount of heat, and requires a large space to accomodate an appropriate electromagnet.

The shed-forming device disclosed in European patent specification No. 0 219 437, operates with a weak electromagnet means; however, that configuration does not involve any air gap which has to be traversed. To provide such a design configuration, the arrangement requires additional arresting elements; e.g., pivotal levers which are additionally supported with hooks and springs. Accordingly, the additional mounting means subject the levers to heavy loadings and, in general, the additional components result in greater expense and increased incidences of malfunction.

SUMMARY OF THE INVENTION

An object of the present invention is to provide a shed-forming device which does not suffer substantially from the above-mentioned disadvantages.

Another object of the invention is to provide a shed-forming device for a textile machine in which a magnetic force required to produce an arresting position of the arrangement does not have to act across an air gap.

Still another object of the present invention is to provide a shed-forming device for a textile machine, such as a loom, which involves a small number of movable components while affording reliability of operation of the arrangement.

The invention provides a lift blade and hooking engagement shed-forming apparatus for a textile machine such as a loom. In particular, the invention includes lift blades (e.g., 1,2,3) capable of opposing movement and hooking engagement elements (e.g., 4,4',4'') adapted to be engaged by the lift blades in a hooking engagement position. The hooking engagement elements are connected in pairs by flexible connecting members (e.g., 9) forming a loop therebetween. Rollers (e.g., 12) which are carried in the respective loops, are operatively connected to the shedding means (e.g., 13) such as the heald train or harness train of a textile machine. Stationary electromagnets (e.g., 5) are operatively arranged to contact the hooking engagement elements and further adapted to be actuated by way of program carriers and a power source (e.g., 16). Each hooking engagement element is adapted to be supported by a support leg (e.g., 8) adapted to engage a stationary support bar, (e.g., 17) disposed at the level of the lower-shed position of the hooking engagement elements. The support leg is adapted to fit into a channel recess (e.g., 18) in a stationary support bar (e.g., 17) when the hook engagement element is in the lower-shed position. The channel recess is specially configured such that the hook engagement element is able to pivot toward and away from the attendant electromagnet. Pivoting of the hook engagement element is facilitated by the contacting of sliding surfaces (e.g., 21) of the lift blade which, in the lower-shed position, slides against a projection (e.g., 19) on the hook engagement element.

To facilitate movement to the upper-shed position, a hook portion (e.g., 7) is arranged on the hook engagement element capable of receiving complementary hook portions (e.g., 20) of the lift blades as the lift blades are driven upwardly.

Thus, in operation, as one lift blade engages the corresponding hooking engagement element and pulls the element to the upper-shed position in order to effect a change of shed, the other lift blade of the pair slides against the corresponding hooking engagement element pivoting the element against the electromagnet in the lower-shed position whereby, upon actuation of the electromagnet, the hooking engagement element is held in the lower-shed position.

DESCRIPTION OF THE PREFERRED EMBODIMENT

Figure 1:
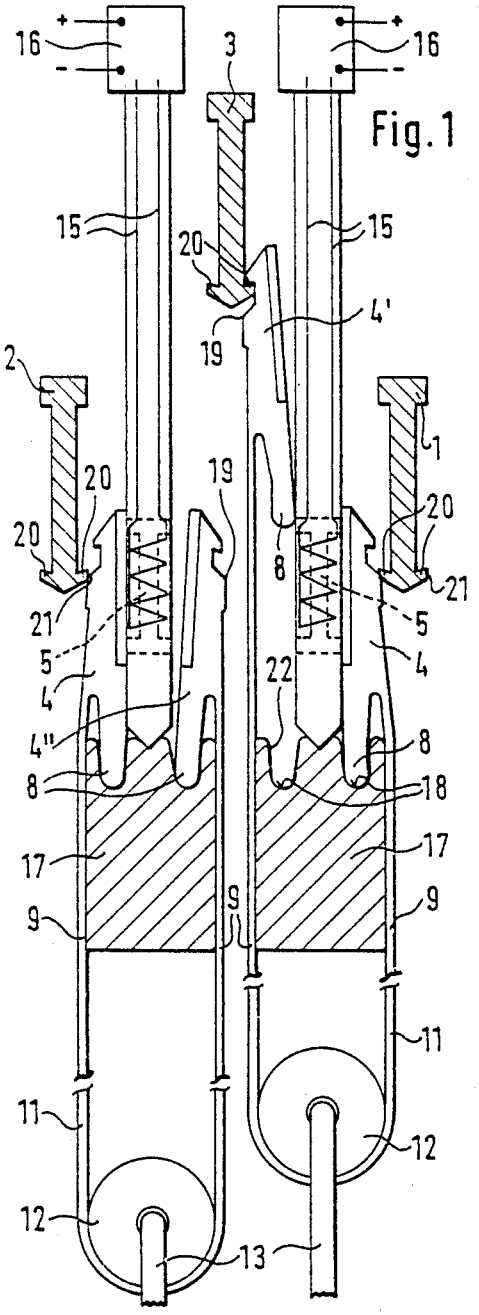
FIG. 1 is a diagrammatic view of a shed-forming device with a lower-shed position and an upper-shed position.
Figure 2:
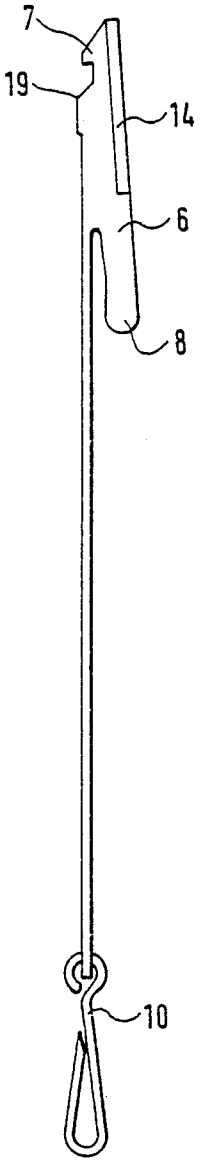
FIG. 2 shows a hooking engagement element according to the invention.

Adverting to FIG. 2, the invention is shown to include a plurality of lift blades 1, 2 and 3 adapted to be moved upwardly and downwardly by a suitable drive arrangement (not shown). Lift blades 1, 2 are shown to be at the bottom dead center position of their lift movement, while lift blade 3 is shown at the top dead center point of the lift movement. The device further comprises hooking engagement elements 4, 4', 4'' shown in various positions. Specifically, hooking engagement elements 4 at the extreme right and the extreme lift in FIG. 1 are in a pivoted condition and are attracted by an electromagnet 5.

Continuing to refer to FIG. 1, hooking engagement element 4' has been moved into the top dead center point of the movement by lift blade 3.

Similarly, FIG. 2 also shows a hooking engagement element 4" in the lower-shed position, but not pivoted towards and into contact with electomagnet 5.

Adverting to FIG. 2, hooking engagement element 4 is shown to include an elongated, specially configured main body portion 6, typically formed of plastic, which at its upper end has a hook means 7 and at its lower end, a support leg 8. Formed on the body portion, intermediate the hooking means and support leg, is a connecting element 9 having a spring tongue-like portion which is connected at its lower end to a clip hook 10. A pair of hooking engagement elements can be connected by appending the clip hooks to flexible connecting members 11 thereby forming a loop. Disposed within the loop is a roller 12 to which a selected shedding means, such as a harness train 13, is operatively connected.

Hooking engagement element 4 also includes a magnetic armature 14 arranged to face the electromagnet when the hooking engagement element is in the lower-shed position. This configuration is illustrated by the extreme right-hand hooking engagement element of FIG. 1.

Continuing to advert to FIG. 1, electromagnets 5 are each operatively arranged at stationary locations between connected pairs of hooking engagement elements and are supplied with electrical power and actuated by power lines 15 and related electronic components 16.

Also disposed at stationary locations are support bars 17, each of which have channel-like recesses or openings 18 for receiving the support legs 8 of the hooking engagement elements when in the lower-shed positons. The recesses are so that, when the hooking engagement elements are not pivoted into position against the hooking engagement elements support legs 8 bear against the upper side of the recess which forms a stop or abutment 22. Similarly, the lower portion of each recess is adapted to the rounded configuration of the support leg, while, the upper portion is wider to provide a gap in which the support leg can pivot against the respective electromagnet. Continuing to advert to FIG. 1, such pivotal movement is produced by the respective lift blade 1, 2 or 3 as it moves downwardly past the respective hooking engagement element 4, 4', 4". For that purpose, each hooking engagement element 4 includes a projection 19 which projects into the path of movement of the respective lift blade when the hooking engagement element is not pivoted into contact with the electromagnet.

Each lift blade is also provided with hook portions 20 which co-operate with the projection 19 and with sliding surface 21. Thus a lift blade comes into contact with an associated hooking engagement element, projection 19 and the sliding surface 21 come into sliding contact with each other, and the hooking engagement element is pivoted into position against the respective electromagnet. Specifically the hooking engagement element magnet armature bears against the associated electromagnet without an air gap therebetween, so that the magnetic forces produced by the electromagnet upon actuation thereof do not have to traverse an air gap in order to arrest the hooking-engagement element.

Continuing to advert to FIG. 1, the connecting element 9 connected to the respective hooking engagement element 4 is disposed in the direction of the line of pulling force, as can be seen, for example, by considering lift blade 3 and hooking engagement element 4' associated therewith. Support leg 8 of the hooking engagement element however, is arranged outside the pulling force line. Accordingly, the hooking engagement element takes up the hooking engagement position on account of the pulling force applied thereto by the shedding means, such as the heald or harness train of the machine.

It will be appreciated that the above-described construction has been set forth solely by way of example and illustration of the principles of the present invention and that various modifications and alterations may be made therein without thereby departing from the spirit and scope of the invention.

This arrangement affords the advantage that the positive movement of the lift blade means that the hooking engagement element is pivoted into a holding position in which the hooking engagement element bears against the electromagnet means without an air gap therebetween so that the hooking engagement element is held fast in that position, when the electromagnet means is activated, without having to overcome or traverse an air gap. On the other hand, the action of the support leg means and the support bar and the effect of the return pulling force of the shedding means, such as the harness or heald arrangement of the machine, means that the hooking element can be pivoted into the hooking engagement position. In that way, no additional components or members are required for moving the element which is to be arrested by the electromagnet means, towards same, with the result that the electromagnet means can be of small sizes. That, in turn, results in the assembly occupying a small amount of space and having a low level of power consumption. In addition, only a small number of movable components are involved, and that in turn means that the frictional forces involved in operation of the arrangement are low, assembly is a simple matter, manufacturing costs can be kept down, and the susceptibility to trouble of the assembly is also low, which results in a low repair and maintenance requirement. In the shed-forming device according to the invention, therefore, the hooking engagement element on the one hand performs the lift movement, while, on the other hand, it can be readily pivoted into the hooking engagement position without the magnetic force having to act across an air gap.

In a preferred feature of the invention, the support leg means may be arranged outside the line of pulling force between the holding means and the loop-forming connecting member, in such a way that the hooking engagement element is pivoted into the hooking engagement position by the shedding means, such as the heald or harness train. That design configuration means that the hooking engagement element is caused to pivot into the hooking engagement position without the use of additional components, such as springs or the like, by virtue of the pulling force of the shedding means of the textile machine. The arrangement may also be such that the hooking engagement element is pivoted in the opposite direction, that is to say towards the electromagnet means, by the shedding means of the machine.

Another advantageous feature of the invention provides that the hooking engagement element comprises a main body portion with a hooking means formed at one end thereof, a support leg formed at the other end thereof, and a connecting element which is of a spring tongue-like configuration and which is formed between the hooking means and the support leg. That arrangement provides the advantage that, due to the spring tongue-like connecting element, not only can the hooking engagement element perform a pivotal movement, but, in addition, the spring action of the connecting element has at the same time the positive effect that the movement of the hooking engagement element into the hooking engagement position can be boosted and materially assisted thereby.

Another preferred feature of the invention may provide that the hooking engagement element is made in one piece from plastic material and has a magnet armature at the side thereof which is towards the electromagnet means in the lower-shed position. That arrangement gives the advantage that both in the condition of hooking engagement with the lift blade, which generally comprises metal, and also in the condition of being supported against the support bar, which preferably comprises metal, contact occurs between plastic material and metal, which permits a lubrication-free mode of operation. Furthermore, that design configuration means that the hooking engagement element can be manufactured in a simple procedure using an injection molding process without subsequent trimming, finishing or like machining operations being required. The above-mentioned magnet armature may be provided on the hooking engagement element for example in manufacture thereof by being injection-molded therein of thereon or by being subsequently attached thereto, as by clipping, adhesive or in some other suitable fashion.

Another feature of the invention may provide that the hooking engagement elements each have a projection which projects into the path of movement of the respective lift blades in the hooking engagement position of the hooking engagement elements, and the lift blades, on hooking portions htereof which co-operate with the hooking engagement elements, have sliding surfaces so that when contact occurs between those sliding surfaces and the projections on the hooking engagement elements, the latter are pivoted into one of the pivotal positions, preferably the position of bearing against the electromagnet means. In that way, the hooking engagement elements can be moved closely to the electromagnet means so that the magnetic force produced thereby for holding the hooking engagement element in position does not have to overcome an air gap, with the result that the electromagnet means can be of a smaller capacity as they only have to produce a lower level of attraction force.

What is claimed is:

1. A shed-forming device for a textile machine having a shedding means for producing a pulling force along a line, comprising: a plurality of lift blades moveable in opposition to each other; a plurality of adjacent hooking engagement elements, said hooking engagement elements including means for pivoting between a first position in which said hooking engagement elements are engaged by said lift blade for entrainment thereby and a second position of non-engagement by the respective lift blade, said hooking engagement elements mounted to move vertically between an upper shed position and a lower shed position; a connecting member connecting each of two adjacent hooking engagement elements to form a respective pair, said connecting member forming a respective loop configuration; a roller carried in each of said look configurations; means connecting each of said rollers to said shedding means of the machine; a electromagnet means disposed at a stationary location between the hooking engagement elements of each of said pair connected by means of said connecting member, at the level of said lower shed position thereof; a support bar positioned to support said hooking engagement element at a stationary location at the level of said lower shed position of said hooking engagement elements; an abutment defining said first position of said hooking engagement element; and means for selectively actuating said electromagnet means whereby in said lower shed position said hooking engagement elements are pivotable between said second position in which they are attracted to the said electromagnet means and said first position.

2. A shed forming device as set forth in claim 1 wherein each of said hooking engagement elements has a support leg means co-operable with said support bar and arranged outside said line of pulling force produced by said shedding means such that said hooking engagement element is positioned by said pulling force in one of said pivotal positions.

3. A shed forming device as set forth in claim 1 wherein each of said hooking engagement elements comprises a main body portion having first and second ends, a hooking means thereon at said first end, a support leg means co-operable with said support bar at said second end, and a connecting element of a spring tongue-like configuration disposed on said main body portion between said first and second ends.

4. A shed forming device as set forth in claim 3 wherein each of said hooking engagement elements is formed in one piece from plastic and further includes a magnet armature arranged to face said electromagnet means in said lower shed position.

5. A shed-forming device as set forth in claim 1 wherein each of said hooking engagement elements has a projection mounted to contact said lift blade in said first position of the hooking engagement element, and wherein each of said lift blades further includes a sliding surface arranged on said lift blades to come into contact with the projection of said hooking engagement element for pivoting said hooking engagement element into said second position.

6. A shed-forming device for a textile machine, comprising: a plurality of lift blades; a plurality of adjacent hooking engagement elements mounted to pivot between a first position in which said hooking engagement elements are engaged by a respective lift blade for entrainment thereby and a second position of non-engagement, said hooking engagement elements mounted to move vertically between an upper shed position and a lower shed position; a flexible connecting member connecting each of two adjacent hooking engagement elements to form a respective pair and whereby said adjacent hooking engagement elements are connected such that said hooking engagement elements move in opposite relationship to each other, said connecting member forming a loop configuration; a roller carried in said loop configuration; means operatively connecting said roller to said shedding means of the machine; an electromagnet means disposed between said hooking engagement elements of each of said pair at the level of said lower shed position thereof; a support bar disposed at the level of said lower shed position of said hooking elements engagement and further disposed to support said hooking engagement elements; an abutment defining said first position for each of said hooking engagement elements; contact portions on each of said hooking engagement elements and said associated lift blade, said portions being mounted such that during movement of said lift blade towards said lower shed position said lift blade contacts the said associated hooking engagement element such that said hooking engagement element pivots to said second position thereof; means for selectively actuating said electromagnet means whereby in said lower shed position said hooking engagement elements are held in said second position by the attractive force of said electromagnet means after having been pivoted substantially into said second position by the cooperation of said contact portions on said hooking engagement element and said lift blade.

* * * * *